United States Patent [19]

Tabuchi et al.

[11] Patent Number: 5,015,338

[45] Date of Patent: May 14, 1991

[54] METHOD OF MANUFACTURING A STAMPER FOR FORMATION OF OPTICAL INFORMATION CARRYING DISK

[75] Inventors: Hirotoshi Tabuchi; Osamu Kumasaka; Katsura Ito; Kenji Koushiro, all of Yamanashi, Japan

[73] Assignee: Pioneer Electronic Corp., Yamanashi, Japan

[21] Appl. No.: 346,537

[22] Filed: May 2, 1989

[30] Foreign Application Priority Data

Sep. 19, 1988 [JP] Japan ..... 63-234034

[51] Int. Cl.[5] ..... C25D 1/10

[52] U.S. Cl. ..... 204/5; 204/38.4

[58] Field of Search ..... 204/5, 38.4

[56] References Cited

U.S. PATENT DOCUMENTS 4,430,401 2/1984 Wilkinson ..... 430/8

4,474,650 10/1984 DeLaat ..... 204/5

*Primary Examiner*—John F. Niebling

*Assistant Examiner*—William T. Leader

*Attorney, Agent, or Firm*—Wegner, Cantor Mueller & Player

[57] ABSTRACT

A method for preparing a stamper comprises the steps of forming a first electro-conductive layer and a second electro-conductive layer on a photoresist layer carrying pits through a physical vapor deposition before the electroforming of a stamper layer. The second electro-conductive layer is effective for preventing the first electro-conductive layer from corroding during the electroforming step because of the active treatment solution for the electroforming and also avoids the corrosion of the first electro-conductive layer even in the storage period before the particular electroforming step.

5 Claims, 2 Drawing Sheets

PRIOR ART
Fig. 1
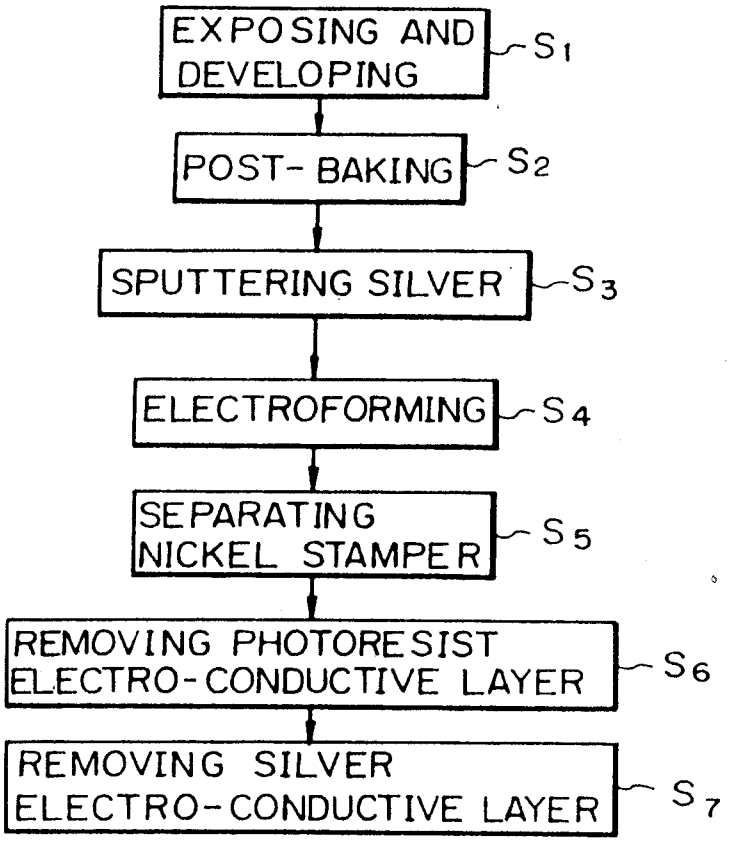
PRIOR ART
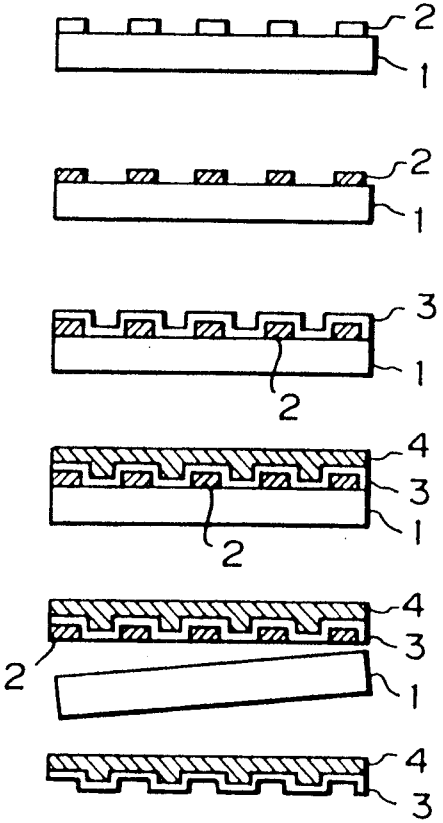
Fig. 2A
Fig. 2B
Fig. 2C
Fig. 2D
Fig. 2E
Fig. 2F
Fig. 2G EXPOSING AND DEVELOPING
S11
POST-BAKING
S12
SPUTTERING SILVER
S13
SPUTTERING NICKEL
S14
ELECTROFORMING
S15
SEPARAKING NICKEL STAMPER
S16
REMOVING PHOTORESIST ELECTRO-CONDUCTIVE LAYER
S17
REMOVING SILVER ELECTRO-CONDUCTIVE LAYER
S18

METHOD OF MANUFACTURING A STAMPER FOR FORMATION OF OPTICAL INFORMATION CARRYING DISK

BACKGROUND OF THE INVENTION

1. Field of the Invention

The present invention relates to a method for manufacturing a stamper which is an electroformed mold to be used for making an optical information carrying disk such as an optical video disk etc. which bears many minute pits on the major surface thereof.

2. Description of the Prior Art

In a known method, a silver layer is formed through sputtering on a photo resist layer formed on a glass plate as an electro-conductive layer and then a nickel layer is formed on the silver layer through electroforming. Then, the nickel layer as well as the silver plate glass are peeled from the glass plate as the stamper. These steps are illustrated by steps S1 through S7 is a flowchart of FIG. 1.

In the exposing and developing step S1, a flat glass circular plate 1 previously coated with a photoresist layer 2 is exposed to a digitally modulated laser beam in the coated side. The photoresist layer 2 of the glass circular plate 1 is then developed or etched to form pits corresponding to the modulating digital signal carried by the laser beam. The glass circular plate 1 becomes a developed master disk on which many pits (P) are formed at the photoresist layer 2 as shown in FIG. 2A.

In the post-baking step S2, the developed master disk is heated so that the photoresist layer 2 bearing pits is dried and rigidly postcured on the glass circular plate 1 as shown in FIG. 2B.

In the silver sputtering step S3, silver (Ag) is deposited on the photoresist layer 2 bearing pits and the glass circular plate 1 through a sputtering process to form a silver electro-conductive layer 3 on the photoresist layer 2 and the glass circular plate 1 as shown in FIG. 2C. In this way, electro-conductivity is given by means of the silver electro-conductive layer 3 on the surface of the photoresist layer 2.

In the electroforming step S4, nickel (Ni) is continuously and electrically deposited or plated on the silver electro-conductive layer 3 by a predetermined thickness through an electrolytic deposition so to form a nickel electro-conductive layer or stamper 4 as shown in FIG. 2D.

In the nickel stamper separating step S5, the nickel electro-conductive layer or stamper 4 with the photoresist layer 2 and silver electro-conductive layer 3 is separated from the glass circular plate 1 as shown in FIG. 2E.

In the photoresist layer removing step S6, the photoresist layer 2 is removed from the silver electro-conductive layer 3 born on the nickel electro-conductive layer or stamper 4 as shown in FIG. 2F. An alkali solution or organic solvent is used for the removing step.

In a silver electro-conductive layer removing step S7, the silver electro-conductive layer 3 is removed from the nickel electro-conductive layer or stamper 4 as shown in FIG. 2G. In this way, the nickel stamper 4 is produced.

However, there is a problem in the above-mentioned known process that the silver electro-conductive layer 3 is apt to be corroded during the storage period before starting the electroforming step and the electroforming step per se. Therefore, the corroded portion appeared on the silver electro-conductive layer 3 results in damages on some pits of the nickel stamper so as to cause some drop-outs of the recorded digital signal. The corrosion of the silver electro-conductive layer 3, further causes the surface of the silver electro-conductive layer 3 to become rough so that a signal to noise ratio (S/N) is lowered in the reproduced signal, and the reproduced image from an optical video disk is deteriorated.

SUMMARY OF THE INVENTION

A primary object of the present invention is to provide a method for manufacturing a stamper capable of readily removing from the photoresist layer while avoiding adverse influence because of the possible corrosion of the silver layer.

A method for manufacturing a stamper according to the present invention comprises the steps of;

forming a first electro-conductive layer made of a first metal material on a surface of a master disk bearing minute pits corresponding to a data signal through physical vapor deposition;

laminating a second electro-conductive layer made of a second metal material on the first electro-conductive layer through the physical vapor deposition, the first and second metal materials being readily separable from each other;

electroforming the second metal material on the second electro-conductive layer so as to form a stamper layer;

separating the stamper layer as well as the first electro-conductive layers from the master disk; and removing the first electro-conductive layer from the stamper layer thereby to produce a stamper made of the second nickel material.

BRIEF DESCRIPTION OF THE DRAWINGS

FIG. 1 is a flowchart showing a conventional method for manufacturing the stamper;

FIGS. 2A, 2B, 2C, 2D, 2E, 2F and 2G are sectional views of a device including a glass circular plate etc. under treatment respectively showing states corresponding to the respective steps of the conventional method shown in FIG. 1;

DESCRIPTION OF THE PREFERRED EMBODIMENT

Figures 3, 4A, 4B, 4C, 4D, 4E, 4F, 4G, 4H:
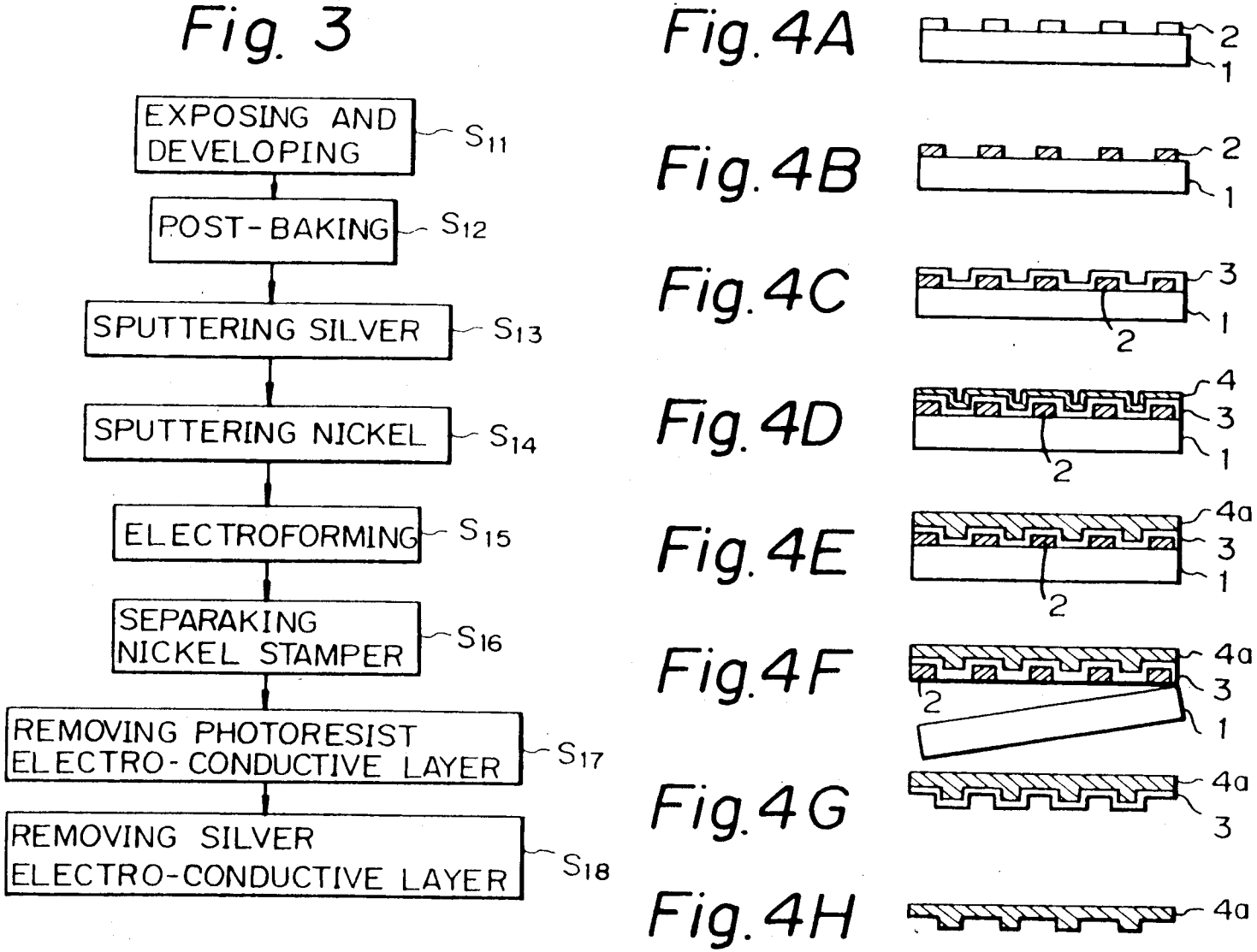
FIG. 3 is a flowchart showing a method for manufacturing the stamper according to the present invention.
FIGS. 4A, 4B, 4C, 4D, 4E, 4F, 4G and 4H are sectional views of a device including a glass circular plate etc. under treatment respectively showing state, corresponding to the respective steps of the method shown in FIG. 3.

An embodiment according to the present invention will be explained while referring to the accompanying drawings hereinafter.

A method for manufacturing a stamper is illustrated in a flowchart of FIG. 3 which includes steps S11 through S18.

(1) Preparation of a master disk carrying minute pits corresponding to a data signal (Exposing and developing step S11 and Post baking step S12):

A flat glass circular plate 1 coated with a photoresist layer 2 is exposed to a digitally modulated laser beam at the coated side while rotating. The photoresist layer 2 of the glass circular plate 1 is then developed or etched to form pits corresponding to the modulating digital signal carried by the layer beam. The glass circular plate 1 becomes a developed master disk on which many pits (P) are formed at the photoresist layer 2 as shown in FIG. 4A. This is an exposing and developing step S1.

In the post baking step S12, the developed master disk is then heated so that the photoresist layer 2 bearing pits is dried and rigidly postcured on the glass circular plate 1 as shown in FIG. 4B.

(2) Formation of a first electro-conductive layer (Silver sputtering step S13):

Silver (Ag) as a first metal material is deposited on the photoresist layer 2 bearing pits and the glass circular plate 1 through physical vapor deposition such as a sputtering process so as to form a silver electro-conductive layer 3 as a first electro-conductive layer on the photoresist layer 2 and the glass circular plate 1 in the silver sputtering step S13. In this way, the master disk carries the first electro-conductive layer by means of the silver electro-conductive layer 3 as shown in FIG. 4C.

(3) Formation of a second electro-conductive layer (Nickel sputtering step S14):

Nickel (Ni) as a second metal material is deposited on the silver electro-conductive layer 3 through a sputtering process so as to form a nickel layer 4 as a second electro-conductive layer at the nickel sputtering step S14. In this way, the master disk carries the second electro-conductive layer by means of the nickel material as shown in FIG. 4D. Chromium (Cr) may be used as the second electro-conductive layer in stead of nickel material because of good separability from the first electro-conductive layer of silver. The second electro-conductive layer 4 of nickel is preferably so thick as to effectively to prevent a treating liquid of the electroforming bath from damaging the first electro-conductive layer of silver.

Although the sputtering process is used in the silver and nickel layers formation steps S13 and S14, a vacuum deposition or electroless plating may be used in stead of the sputtering process. The physical vapor deposition such as the vacuum deposition and the sputtering is preferred because the first and second electro-conductive layer forming processes are continuously performed in one vacuum chamber so as to increase the efficiency in the manufacture.

(4) Electroformation of a nickel stamper layer (Electroforming step S15):

Nickel (Ni) is continuously and electrically deposited or plated on the nickel layer 4 until a stamper layer of a predetermined thickness in formed in the electroforming step S15. In this way, a nickel stamper layer **4*a* is integrally formed on the nickel layer 4 as shown in FIG. 4E**.

(5) Separation of the nickel stamper layer from the glass circular plate (Nickel stamper separating step S16):

The nickel electro-conductive layer or stamper layer **4*a* with the photoresist layer 2 and the silver electro-conductive layer 3 is separated from the glass circular plate 1 as shown in FIG. 4F through the nickel stamper separating step S16**.

(6)Removal of the first electro-conductive layer (Photoresist layer removing step S17 and Silver electro-conductive layer removing step S18):

In a photoresist layer removing step S17, the photoresist layer 2 is removed from the silver electro-conductive layer 3 placed on the nickel stamper layer **4*a* as shown in FIG. 4G**.

In a silver electro-conductive layer removing step S18, the silver electro-conductive layer 3 is removed from the nickel stamper layer **4*a* as shown in FIG. 4H. The removal of silver electro-conductive layer is performed in such a manner that the stamper as a whole is immersed in a treatment solution including ammonia, hydrogen peroxide and water. If necessary, an ultrasonic wave is applied thereto during this treatment. Another treatment solution dissolving only the silver electro-conductive layer 3 without damaging the second electro-conductive layer 4*a*** of nickel or chromium may be used. In this way, the nickel stamper is produced.

In the silver sputtering step S13, although silver (Ag) is used as the first electro-conductive layer, a readily removable metal such as copper, aluminum, zinc, etc. may be used and deposited as the first electro-conductive layer on the photoresist layer 2, because these metals are readily removable and separable from the second electro-conductive layer of nickel or chromium by the treatment solution.

EXAMPLES

Various nickel stampers were prepared as examples through the above mentioned process in each of which silver was sputtered as the first electro-conductive layer, nickel was sputtered as the second electro-conductive layer.

The first electro-conductive layer of silver was formed within a range of thickness of 50Å through 200Å. The thickness of the first electro-conductive layer was thinner than that of the conventional silver electro-conductive layer. When the first electro-conductive layer was thicker than 200Å, the shapes of pits was deteriorated and the surface carrying the pits was rough. When the first electro-conductive layer was thinner than 50Å, it was difficult to remove the first electro-conductive layer together with the photoresist layer 2 from the glass plate. Therefore, it was revealed that the thickness of the first electro-conductive layer of silver should be preferably within a range of 50Å through 200Å.

When the second electro-conductive layer was thicker than 1000Å, the internal stress rose causing cracks of the electro-conductive layer of nickel during the electroforming step. When the second electro-conductive was thinner than 200Å, it was difficult conductive layer to electoform the electro-conductive layer due to reduction of amperage in the initial state thereof. Therefore, it was revealed that the thickness of the second electro-conductive layer of nickel should be preferably within a range of 200Å through 1000Å.

As mentioned above, the method for preparing the stamper according to the present invention comprises the steps of forming the first and second electro-conductive layers on the photoresist layer through the physical vapor deposition, these layers being used for the electroforming of the stamper. Therefore, the second electro-conductive layer is effective for preventing the treatment solution from corroding the first electro-conductive layer during the electroforming step and also avoids the corrosion of the first electro-conductive layer in the storage period before starting the electroforming step. The first electro-conductive layer with the photoresist layer is readily removed from the stamper without deforming the shapes of the pit. The photoresist layer is perfectly removed. As a result, the minute pits formed on the stamper have clear and smooth surfaces.

What is claimed is:

1. A method for manufacturing a stamper for the formation of an optical information carrying disk, which comprises the steps of:

forming a first electro-conductive layer made of a first metal material on a surface of a master disk bearing minute pits corresponding to a data signal through physical vapor deposition;

depositing a second electro-conductive layer made of a second metal material on said first electro-conductive layer through physical vapor deposition, said first and second metal materials being readily separable from each other;

electroforming said second metal material on said second electro-conductive layer so as to form an electroformed layer integral with said second electro-conductive layer, said second electro-conductive layer and said electroformed layer together forming a stamper layer;

separating said stamper layer and said first electro-conductive layer from said master disk; and removing said first electro-conductive layer from said stamper layer thereby producing the stamper made of said second metal material.

2. A method according to claim 1 wherein said first metal material is silver, and said second metal material is nickel.

3. A method according to claim 1 wherein said physical vapor deposition is a sputtering process.

4. A method according to claim 1 wherein said physical vapor deposition is a vacuum deposition process.

5. A method according to claim 1 wherein the thickness of said first electro-conductive layer is within a range of 50Å through 200Å, and the thickness of said second electro-conductive layer is within a range of 200Å through 1000Å.

* * * * *

UNITED STATES PATENT AND TRADEMARK OFFICE

CERTIFICATE OF CORRECTION

PATENT NO. : 5,015,338

DATED : May 14, 1991

INVENTOR(S) : Hirotoshi Tabuchi; Osamu Kumasaka; Katsura Ito; Kenji Koushiro

It is certified that error appears in the above-identified patent and that said Letters Patent is hereby corrected as shown below:

ON TITLE PAGE:

[73] Assignee: Pioneer Electronic Corporation, Tokyo, Japan
Pioneer Video Corporation, Yamanashi, Japan

Signed and Sealed this

Twenty-ninth Day of September, 1992

*Attest:*

DOUGLAS B. COMER

*Attesting Officer*

*Acting Commissioner of Patents and Trademarks*